US007980030B2

(12) United States Patent
Kwon

(10) Patent No.: US 7,980,030 B2
(45) Date of Patent: Jul. 19, 2011

(54) C-TYPE UNDERBRACING HAVING ENLARGED END PORTIONS FOR INSTALLING ON UTILITY POLE

(75) Inventor: Sae Won Kwon, Goesan-Gun (KR)

(73) Assignee: Daewon Electric Co. Ltd., Jinchun-Eup, Jinchun-Gun, Choongchungbuk-Do (KR)

( * ) Notice: Subject to any disclaimer, the term of this patent is extended or adjusted under 35 U.S.C. 154(b) by 0 days.

(21) Appl. No.: 12/662,876

(22) Filed: May 10, 2010

(65) Prior Publication Data

US 2010/0269423 A1 Oct. 28, 2010

Related U.S. Application Data

(63) Continuation-in-part of application No. 12/071,197, filed on Feb. 19, 2008, now abandoned.

(30) Foreign Application Priority Data

Jul. 11, 2007 (KR) ..... 10-2007-0069478

(51) Int. Cl.
*E02D 27/42* (2006.01)

(52) U.S. Cl. ..... 52/170; 52/296; 52/169.13; 52/125.3; 248/218.4; 405/244; 405/259.1

(58) Field of Classification Search ..... 52/166, 52/296, 197, 170, 169.13, 125.2, 125.3, 125.5, 52/741.14, DIG. 11, 596, 608; 248/218.4, 248/27.3, 230.5, 231.61, 229.14, 229.242; 405/244, 259.1, 231, 286; 256/65.14; D25/116; 138/158, 159

See application file for complete search history.

(56) References Cited

U.S. PATENT DOCUMENTS

| | | | | | |
|---|---|---|---|---|---|
| 777,600 | A | * | 12/1904 | Childs | 52/166 |
| 934,829 | A | * | 9/1909 | Olsen | 114/300 |
| 1,679,747 | A | * | 8/1928 | Spring | 52/170 |
| 1,715,285 | A | * | 5/1929 | Grubb | 52/298 |
| 2,695,587 | A | * | 11/1954 | Welter | 114/300 |
| D180,678 | S | * | 7/1957 | Veale, Sr. | D25/116 |
| 2,828,515 | A | * | 4/1958 | Jenne | 52/166 |
| 2,883,136 | A | * | 4/1959 | Smalley | 248/230.5 |
| 2,936,786 | A | * | 5/1960 | Versoy et al. | 138/158 |
| 2,970,799 | A | * | 2/1961 | Pinson | 248/230.5 |
| 3,921,949 | A | * | 11/1975 | Coon | 248/219.2 |
| 4,552,390 | A | * | 11/1985 | Calmettes | 285/420 |
| 4,934,644 | A | * | 6/1990 | Nagy et al. | 248/230.8 |
| 5,088,672 | A | * | 2/1992 | Neuendorf et al. | 248/218.4 |

(Continued)

*Primary Examiner* — Robert J Canfield
*Assistant Examiner* — Matthew J Gitlin
(74) *Attorney, Agent, or Firm* — G W i P S

(57) ABSTRACT

A C-type underbracing has developed for installing on a lower portion of a utility pole for firmly anchoring the utility pole. The underbracing is comprised of: a body (12) formed a half-annular or C-shape with a rectangular cross section; a pair of the enlarged end portions (11, 11') having larger rectangular cross section than that of the body; a pair of the conjunction (17, 17') for connecting between the body and the enlarged end portions; a hook receiving hole (13) horizontally through a center of the body, and a pair of nut mounting portions (16, 16') formed flat surfaces for seating the nuts and a pair of slit-shaped holes (14, 14') for horizontally inserting U-bolts (20) through the body portion, the nut mounting portions and slit-shaped holes disposed both sides of said hook receiving hole, and an earth plate (30) made of conductive material is attached to the bottom surface of the body.

2 Claims, 5 Drawing Sheets

U.S. PATENT DOCUMENTS 6,095,466 A * 8/2000 Sener et al. ..... 248/231.61
6,575,652 B2 * 6/2003 Krauss ..... 403/49
6,672,017 B2 * 1/2004 Larson ..... 52/170
7,272,204 B2 * 9/2007 Jensen ..... 376/260
7,306,448 B2 * 12/2007 Neubauer et al. ..... 425/192 R
2005/0161564 A1 * 7/2005 Ganske ..... 248/220.21

* cited by examiner

C-TYPE UNDERBRACING HAVING ENLARGED END PORTIONS FOR INSTALLING ON UTILITY POLE

This is a Continuation in Part (CIP) of Ser. No. 12/071,197 filed Feb. 19, 2008 now abandoned.

BACKGROUND OF THE INVENTION

1. Field of the Invention

The present invention relates to a C-type underbracing installed at bottom end of the utility pole for anchoring. More particularly, the C-type underbracing formed enlarged end portions to facilitate installation on the utility pole by using a crane auger. The body segment between the enlarged end portions is formed C-shape with thinner than the body thickness. Thus, the enlarged end portions of the C-type underbracing will increase the contacting area with the covered soils to improve the resistance and enhance the supporting tension to the utility pole.

2. Description of the Related Art

For example, Korean Patent Application No. 2006-112100, filed by the applicant of the present invention, discloses a utility pole underbracing for utility pole construction. In this underbracing, as shown in FIG. 1, the overall shape of the underbracing 100 is roughly a half toroid. The inner semi-circle surface 101 conforms to the cross-section shape of a utility pole, and the outer semi-circle 102 has a diameter of about 0.8 m. Although this underbracing has a shape different from the conventional bar-type utility pole underbracing, the surface area in contact with soil after mounting is almost the same.

However, the volume is smaller so the weight is less than the conventional rectangular underbracing. Therefore, when excavating the pit for burying the pole during utility pole construction, the excavation volume is greatly reduced compared to the conventional rectangular underbracing, and since it is easier to handle, construction efficiency and workability are improved.

Furthermore, on the outer circumference of the semi-circular utility pole underbracing there are a U-bolt inserting hole 103 used for mounting the underbracing and a slot 104 which increases the cohesion with soil under the earth surface. The inner circumference varies, made according to the curvature specification of the utility pole, resulting in better install ability and increased strength of underbracing.

However, since the above mentioned semi-circular utility pole underbracing is a C-type solid bound by curved surfaces, the adherence area with soil is not sufficient, so the coherence between the pole and the soil is not satisfactory. In the case of assembling with U bolts, the U-bolt insertion hole is of through-hole shape, so the dimensions of the insertion hole and the U bolt should match, which causes difficulty in logistics management, and frictional interference in construction.

Also, since the above mentioned conventional semi-circular utility pole underbracing is relatively large and heavy (95 kg), it is difficult to handle and there are many difficulties with fabrication and transportation. When installing a large and heavy object in the utility pole burial pit by using an extra crane, the process for binding the underbracing to the crane is complicated, and it is also very difficult and toilsome to disconnect the bindings again.

Therefore, the actual site has dire need for an improved utility pole underbracing that has better adherence resistance force with the soil and also is easier to fasten to the pole.

SUMMARY OF THE INVENTION

It is an object of the present invention to provide a C-type underbracing, for installation on a utility pole, wherein there are enlarged portions at both ends of the underbracing and the C-type body portion connecting the enlarged portions at both ends through inclined elements, is constructed smaller than the enlarged portions. The force of ground contact with the soil is improved through the enlarged portions. The utility pole underbracing is made lighter through the body portion being smaller than the enlarged portion. A hook inserting hole is through-formed in the center of the underbracing, so that it is easy to move and put in the utility pole underbracing using a crane. Bolt joining holes of slit shape are formed, separated at a given interval, making it easy to fasten a U bolt through the bolt joining hole.

In accordance with the present invention, there is provided a utility pole underbracing comprising friction-increasing means, which are: enlarged portions formed at both ends of a monolithically-formed utility pole underbracing; a C-type body portion with size and weight reduced; a binding guide means; and fastening means which are bolt joining holes for U bolts installed on the utility pole, formed at both sides of a hook receiving hole.

According to the C-type utility pole underbracing with enlarged portions, for construction of a burial hole for the present invention, the force of contact with the soil is improved by the enlarged portions. The utility pole is made lightweight through a reduced body portion. It is easy to move and install the utility pole underbracing with a crane, by using the hook receiving holes, and U bolts are fastened easily through the bolt joining holes, so there is convenience in construction.

DETAILED DESCRIPTION OF THE PREFERRED EMBODIMENT

Hereinafter, a C-type underbracing of the present invention will be described in detail with reference to the accompanying drawings.

Figure 1:
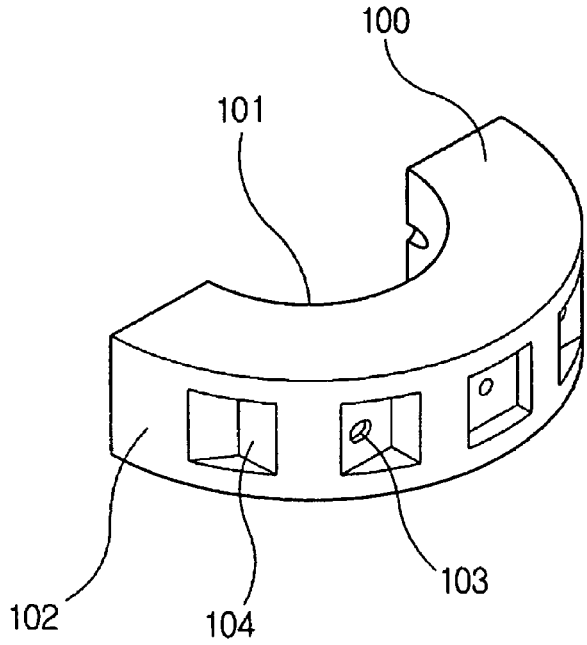
Fig. 1 (Prior Art)
FIG. 1 is a perspective view showing a conventional C-type underbracing of prior art.
Figure 2:
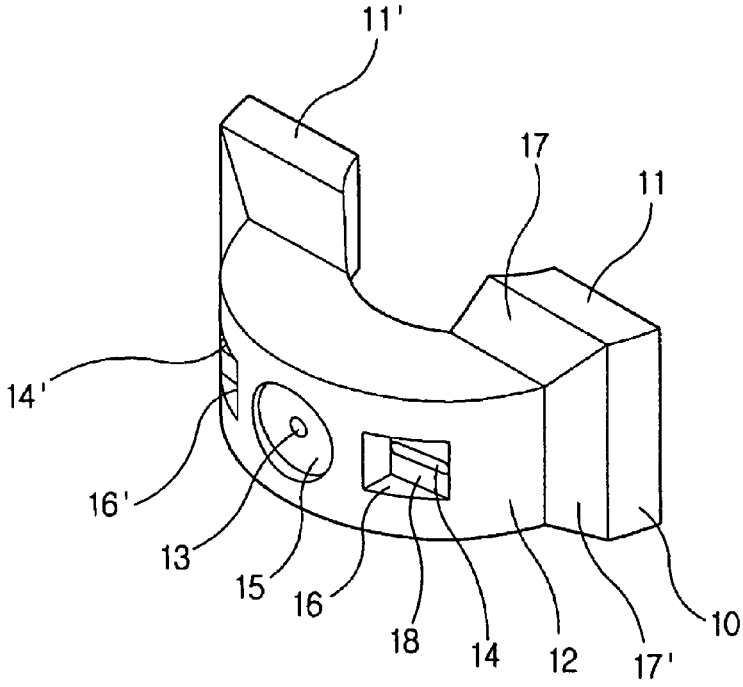
FIG. 2 is a front perspective view showing a C-type underbracing according to the present invention.
Figure 3:
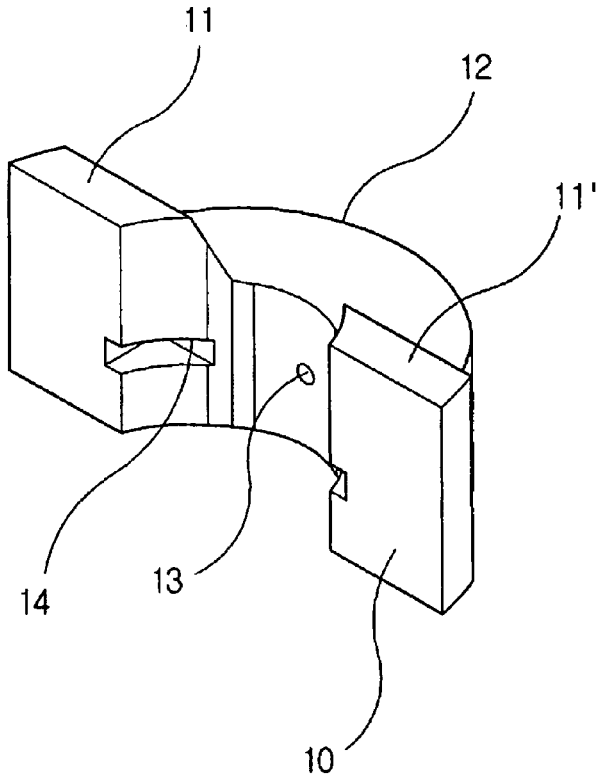
FIG. 3 is a rear perspective view showing the C-type underbracing according to the present invention.
Figure 4:
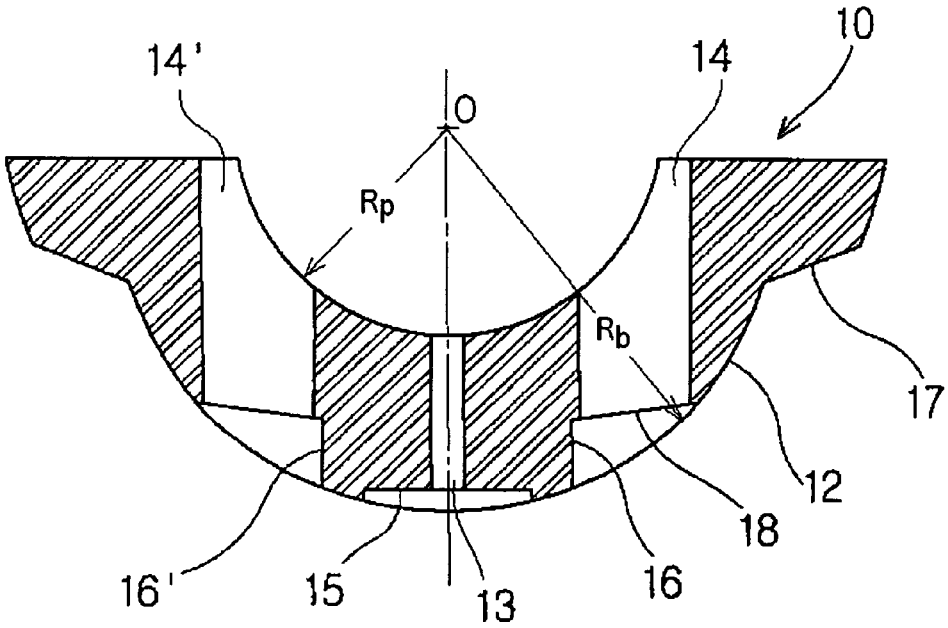
FIG. 4 is a plan sectional view of the C-type underbracing according to the present invention.

FIG. 1 is a perspective view showing a conventional C-type underbracing of prior art, FIG. 2 is a front perspective view showing a C-type underbracing according to the present invention, FIG. 3 is a rear perspective view showing the C-type underbracing according to the present invention, and FIG. 4 is a plan sectional view of the C-type underbracing according to the present invention.

In C-type utility pole underbracing 10 according to the preferred embodiment of the present invention, enlarged portions 11 and 11' with the size-increased upward and sideward are formed respectively at both ends, and the body portion 12 of the underbracing 10 which connects the enlarged portions 11 and 11' through the inclined portions 17 and 17', has a smaller size than the enlarged portions 11 and 11'. In the center of the utility pole underbracing 10 a hook receiving hole 13 is through-formed, and on both sides of the hook receiving hole 13 are bolt inserting holes 14 and 14' of slit shape. Around the hook receiving hole 13 of the body portion 12 there is a first friction-increasing slot 15, concave in shape and of a given depth, and around the bolt-inserting holes 14 and 14' of the body portion 12 there are partly cut-away second friction slots 16 and 16', respectively.

Also, the body portion 12, placed between the enlarged portions 11 and 11' of the utility pole underbracing 10, includes inclined portions 17 and 17' to take a more natural shape and provide excellent durability against external shock applied to the corner.

The C-type underbracing 10 for installing on bottom of a utility pole 21 comprises: a body portion 12 forming a half-annular shaped cylinder with a rectangular cross section. An outer radius Rb of the body portion 12 is approximately 1.82~2.0 times of an inner radius Rp of the body portion 12. An inner radius of the body portion 12 is slightly larger than the outer radius of the utility pole 21.

A pair of the enlarged end portions 11 and 11' has formed a rectangular-shaped blocks with the rectangular cross section. The width and height of the end portions 11 and 11' has enlarged by increment of $\sqrt{2}$ from that of the body portion 12. So that, the rectangular cross sectional area of the enlarged end portions 11 and 11' is twice larger than the rectangular cross sectional area of the body portion 12.

A pair of conjunction portions 17 and 17' has top surfaces, which are inclined from the body portion 12 to the enlarged end portions 11 and 11'. The base surfaces of the conjunction portions are flat and lied on a bottom plane to align the bottom surfaces of the body portion and the enlarged end portions. The inner lateral surfaces of the conjunction portions are contacted to the circumference of the utility pole 21. The outer lateral surfaces of the conjunction portions 17 and 17' are formed the slightly convex contours from the body portion 12 to the enlarged end portions 11 and 11'. So that, the cross sections of the conjunction portions are varied by the increment of $\sqrt{2}$ in the width and the height from the body portion 12 to the enlarged end portions 11 and 11'.

A hook receiving hole 13 has formed horizontally through a center of the body portion 12. A hook mounting seat 15 is formed a circular-shaped flat area, which is sunk-down around the hook receiving hole 13 for increasing frictional forces.

The utility pole underbracing 10, according to another embodiment of the present invention, further comprises an earthing plate 30 attached to the bottom surface of the utility pole underbracing 10, and a ground wire 31, one end of which is connected to the earthing plate 30 and the other end of which is drawn out through the body portion 12, so that the ground wire 31 is effectively connected to the earth line of the utility pole.

Figure 6:
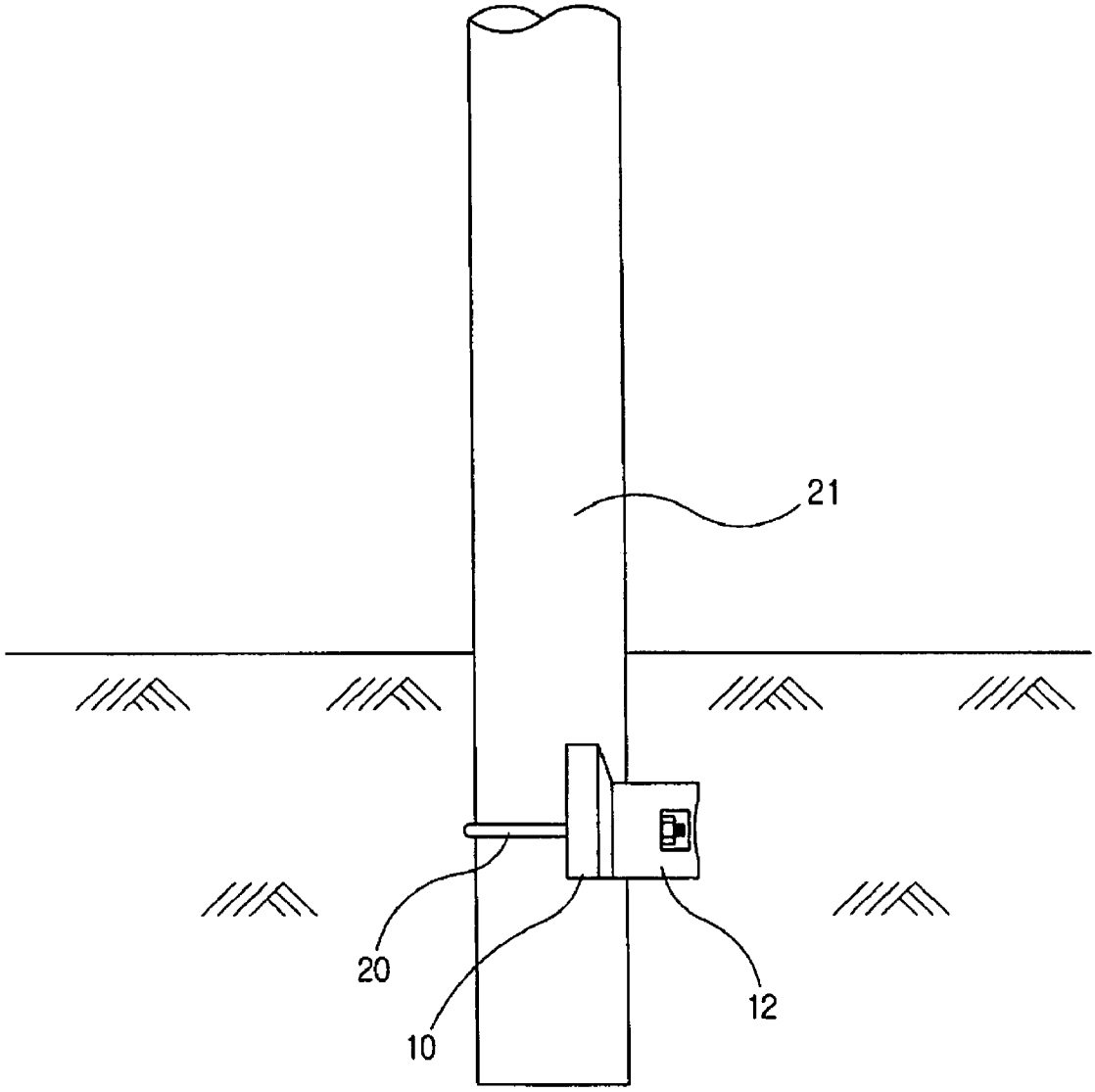
FIG. 6 is a schematic view showing the construction process of a C-type underbracing according to the present invention.

As shown in FIG. 6, the utility pole underbracing 10 is mounted to the utility pole 21 by U bolt 20.

The process of installation of a utility pole, using a C-type utility pole underbracing with enlarged portions, will be described in more detail with reference to the accompanying drawings.

In general, after completing minimum excavation work for burying C-type utility pole underbracing by using equipment such as an auger crane, backhoe or manpower, the utility pole underbracing 10 is mounted to the utility pole 21 by U bolt 20.

Both ends of the C-type utility pole underbracing 10 of the present invention are shaped as enlarged portions 11 and 11' of size-increased shape. Since these enlarged portions 11 and 11' require largely widened areas of interference and friction with soil due to backfilling, the resultant binding force with soil is increased, so the utility pole 21 can be maintained more stably and firmly.

Although proper binding force with soil can be obtained by C-type underbracing alone, the utility pole might be inclined or slanted as a result of soil quality or geologic condition. In such a case, inclination or slant of the utility pole 21 can be prevented by the enhanced binding force with soil of the enlarged portions 11 and 11' on the utility pole underbracing of the present invention.

In addition, the utility pole underbracing 10 of the present invention has a pair of nut mounting portions 16 and 16' forming flat surfaces for seating nuts and a pair of slit-shaped holes 14 and 14' for horizontally inserting U-bolts 20 through the body portion 12, wherein the nut mounting portions 16 and 16' and slit-shaped holes 14 and 14' are disposed proximate both sides of the hook receiving hole 13.

The body portion 12 of a utility pole underbracing 10 according to the present invention has a shape of smaller size than the enlarged portions 11 and 11'. Since the body portion 12 is smaller, the total weight of the utility pole underbracing 10 is reduced greatly and it is easier to handle and install. In addition, since the enlarged portions 11 and 11' and body portion 12 of utility pole underbracing 10 are connected solidly through gentle inclined portions 17 and 17', the total weight of the utility pole underbracing 10 is reduced. Since the increased adherence area with soil can be maintained as it is, the utility pole 21 can be supported more stably.

Figure 5:
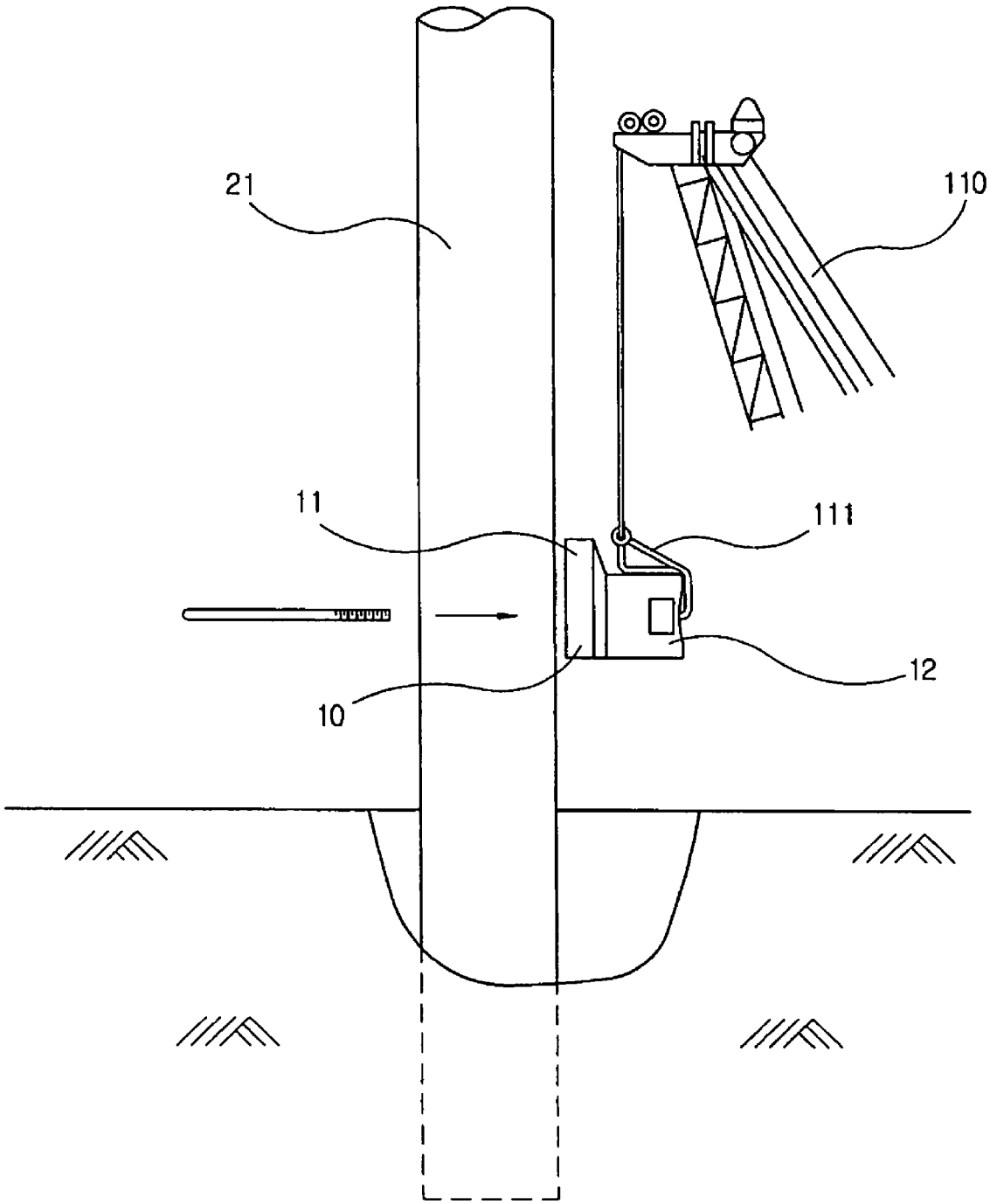
FIG. 5 is a schematic view showing the process of putting in a C-type underbracing in a burial hole according to the present invention.

In the center of the body portion 12 the hook receiving hole 13 is through-formed horizontally. As shown in FIG. 5, during the work of moving and installing utility pole underbracing 10 using crane 110, the utility pole underbracing 10 can be handled more conveniently by inserting the hook 111 into the hook receiving hole 13, for transport and installation of the utility pole underbracing.

The outer circumference of the body portion 12 is provided with the first friction increasing slot 15, formed around the hook receiving hole 13, and the second friction increasing holes 16 and 16', formed around the bolt inserting holes 14 and 14'. Friction resistance strength between the utility pole underbracing 10 and the soil is increased through these first friction slot 15 and second friction slots 16 and 16'. The second friction increasing slots 16 and 16' also create accommodating spaces where stop nuts fastened to the screw portions of U bolt 20 are located during use.

A pair of seating surfaces 18 of the nut mounting portions 16 and 16' is inclined 5°~10° outward for easily tightening the nuts, so that the U bolts 20 and nuts gradually move outward of the slit-shaped holes 14 and 14' to be prevented the nuts and U bolts 20 adhering to the mounting portions 16 and 16' during the installation of underbracing 10. As the nut moves outward along the inclined portion when the nut is fastened, the position of the U bolt gradually moves from the inside to the outside of the bolt inserting holes 14 and 14' while the surface contact portion is increased, so it is possible to fix U bolt firmly and stably.

Therefore, as shown in FIG. 6, the utility pole underbracing 10 mounted on the lower part of the utility pole 21 and buried in soil can get excellent binding force with soil and can be installed easily.

Figure 7:
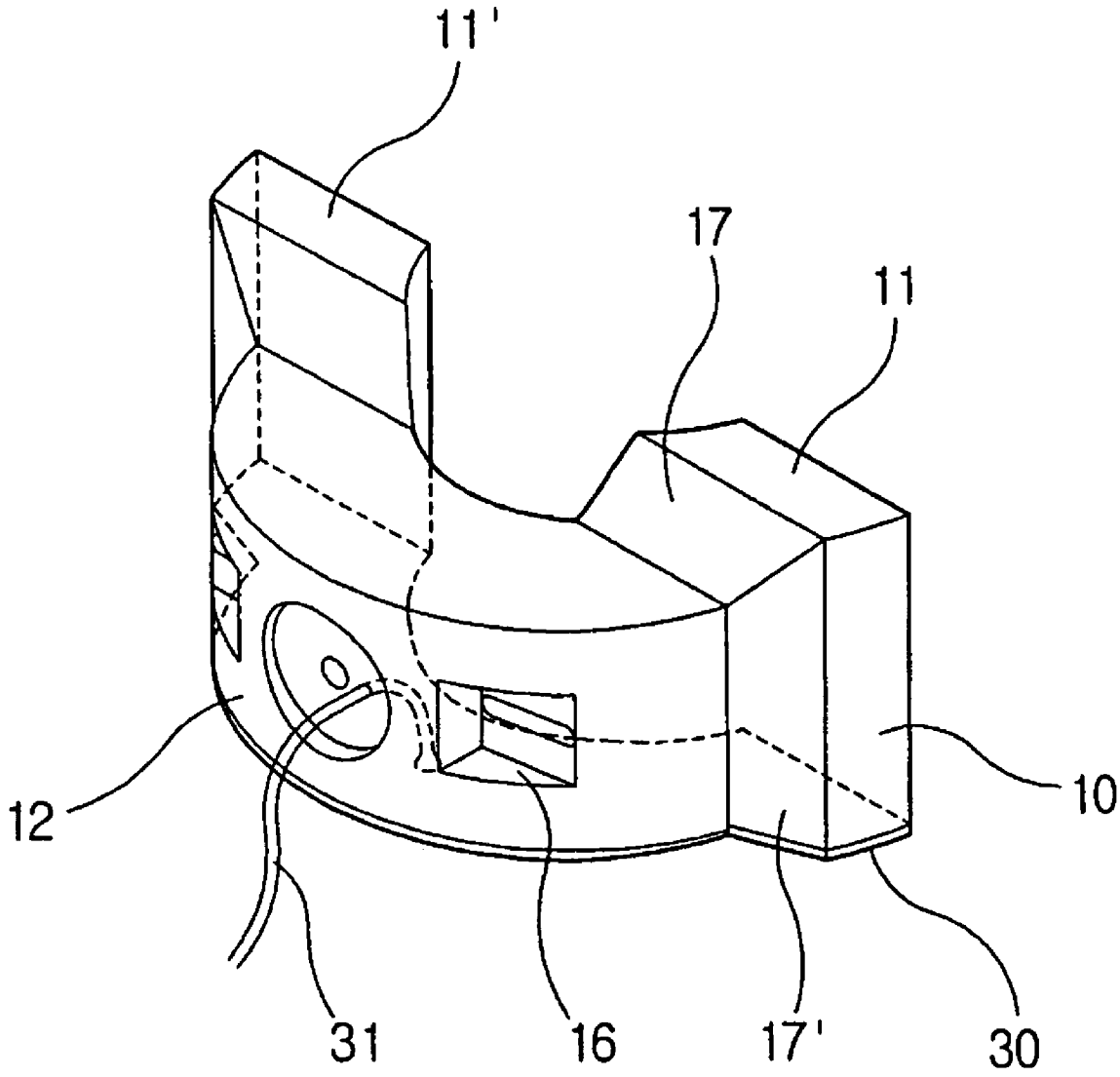
FIG. 7 is a perspective view showing a C-type underbracing according to another embodiment of the present invention.

Meanwhile, the utility pole underbracing according to another embodiment of the present invention has an earthing plate 30 made of metal material attached on the whole bottom surface of the utility pole underbracing 10, and a ground wire 31 connected to the earthing plate 30, as shown in FIG. 7. The ground wire 31 can be used by easily connecting it with the earth line of utility pole, after exposing it outside through the body portion 12 of the utility pole underbracing 10.

Although the present invention has been described in detail reference to its presently preferred embodiment, it will be understood by those skilled in the art that various modifications and equivalents can be made without departing from the spirit and scope of the present invention, as set forth in the appended claims.

What is claimed is:

1. A C-type underbracing (10) for installing on bottom of a utility pole (21), comprising:

a body portion (12) forming a half-annular shaped cylinder with a rectangular cross section, wherein an outer radius (Rb) of the body portion (12) is enlarged when compared to an inner radius (Rp) of the body portion (12), and the inner radius of the body portion (12) is slightly larger than the outer radius of the utility pole (21), a pair of enlarged end portions (11, 11') forming rectangular-shaped blocks with rectangular cross sectional areas, which are larger than that of the body portion (12), a pair of conjunction portions (17, 17') having top surfaces being inclined from the body portion (12) to the enlarged end portions (11, 11'), base surfaces being flat and lying on a bottom plane to align bottom surfaces of the body portion and the enlarged end portions, inner lateral surfaces being contacted to the circumference of the utility pole (21), outer lateral surfaces forming slightly convex contours from the body portion (12) to the enlarged end portions (11, 11'), so that the cross sections of the conjunction portions are varied from the cross section of the body portion (12) in the width and the height portion to the cross sections of the enlarged end portions (11, 11'), a hook receiving hole (13), which is horizontally through a center of the body portion (12), a hook mounting seat (15) forming a circular-shaped flat area, which is sunk down around the hook receiving hole (13) for increasing frictional forces, a pair of nut mounting portions (16, 16') forming flat surfaces for seating nuts and a pair of slit-shaped holes (14, 14') for horizontally inserting U-bolts (20) through the body portion (12), wherein said nut mounting portions (16, 16') and slit-shaped holes (14, 14') are disposed proximate both sides of said hook receiving hole (13), and a pair of seating surfaces (18) of the nut mounting portions (16, 16') being inclined 5°~10° outward for easily tightening the nuts, so that the U bolts (20) and nuts gradually move outward of the slit-shaped holes (14, 14') to be prevented the nuts and U bolts (20) adhering to the mounting portions (16, 16') during the installation of underbracing (10).

2. The C-type underbracing (10) as set forth in claim 1, further comprising an earth plate (30) made of conductive material for attaching to bottom surface of the body portion (12) and a ground wire (31) drawn out from the earth plate (30).

* * * * *